US011335984B2

(12) United States Patent
Lv et al.

(10) Patent No.: US 11,335,984 B2
(45) Date of Patent: May 17, 2022

(54) DIELECTRIC WAVEGUIDE FILTER

(71) Applicant: Kunshan Luxshare RF Technology Co., Ltd., Kunshan (CN)

(72) Inventors: Shance Lv, Kunshan (CN); Shaodong Li, Kunshan (CN); Xinghua Sun, Kunshan (CN)

(73) Assignee: KUNSHAN LUXSHARE RF TECHNOLOGY CO., LTD., Kunshan (CN)

( * ) Notice: Subject to any disclaimer, the term of this patent is extended or adjusted under 35 U.S.C. 154(b) by 0 days.

(21) Appl. No.: 17/038,709

(22) Filed: Sep. 30, 2020

(65) Prior Publication Data

US 2021/0328314 A1 Oct. 21, 2021

(30) Foreign Application Priority Data

Apr. 16, 2020 (CN) ..... 202010298507.5

(51) Int. Cl.
*H01P 3/16* (2006.01)
*H01P 1/20* (2006.01)

(52) U.S. Cl.
CPC ..... *H01P 1/2002* (2013.01); *H01P 3/16* (2013.01)

(58) Field of Classification Search
CPC ..... H01P 1/2002; H01P 1/202; H01P 1/2053; H01P 1/2056; H01P 1/20; H01P 1/201; H01P 1/207; H01P 1/208; H01P 1/2084; H01P 1/2086; H01P 1/2088; H01P 1/205; H01P 3/16; H01P 3/122; H01P 3/112; H01P 3/12; H01P 3/121; H01P 7/10; H01P 7/105
See application file for complete search history.

(56) References Cited

U.S. PATENT DOCUMENTS 10,950,918 B1 * 3/2021 Wu ..... H01P 1/2088

FOREIGN PATENT DOCUMENTS

| | | | |
|---|---|---|---|
| CN | 109687072 | A | 4/2019 |
| CN | 110112517 | A | 8/2019 |
| CN | 110277612 | A | 9/2019 |
| CN | 209766609 | U | 12/2019 |
| CN | 210120218 | U | 2/2020 |

* cited by examiner

*Primary Examiner* — Stephen E. Jones
(74) *Attorney, Agent, or Firm* — Birch, Stewart, Kolasch & Birch, LLP

(57) ABSTRACT

Provided is a dielectric waveguide filter that includes a dielectric main body. A plurality of isolation slots and frequency tuning blind holes are provided in the dielectric main body. At least two port signal transmission holes are further provided in the dielectric main body. The at least two port signal transmission holes and at least part of the plurality of frequency tuning blind holes are disposed on two opposite sides of the dielectric main body. In a thickness direction of the dielectric main body, the at least two port signal transmission holes do not overlap with the at least part of the plurality of frequency tuning blind holes. The dielectric waveguide filter according to embodiments of this disclosure achieves miniaturization while improving out-of-band rejection capability.

16 Claims, 3 Drawing Sheets

DIELECTRIC WAVEGUIDE FILTER

CROSS-REFERENCE TO RELATED APPLICATIONS

This application claims the priority of China patent application No. 202010298507.5 filed on Apr. 16, 2020, disclosure of which is hereby incorporated by reference in its entirety.

TECHNICAL FIELD

The present disclosure relates to the technical field of filters, and in particular, to a dielectric waveguide filter.

BACKGROUND

Along with the development of 5th generation (5G) communication, dielectric waveguide filters have found increasingly spread applications. Accordingly, higher and higher requirements are posed for the performance of the dielectric waveguide filters.

To improve the out-of-band rejection capability of the dielectric waveguide filter, the dielectric waveguide filter typically needs to be configured as a multi-zero structure. In the related art, however, the dielectric waveguide filter needs to be provided with a capacitive coupling column or double-side rows of cavities in order to achieve the multi zeros of the dielectric waveguide filter. As such, the configuration based on capacitive coupling column increases the difficulties in subsequent debugging of the dielectric waveguide filter, while the configuration based on the double-sided rows of cavities results in an increased size of the dielectric waveguide filter. The increased difficulties in subsequent debugging and process limit further application of the dielectric waveguide filter.

SUMMARY

Embodiments of the present disclosure provide a dielectric waveguide filter, so as to achieve miniaturization of the dielectric waveguide filter and expand the application range of the dielectric waveguide filter.

In a first aspect, an embodiment of the present disclosure provides a dielectric waveguide filter. The dielectric waveguide filter includes a dielectric main body, where a plurality of isolation slots and a plurality of frequency tuning blind holes are provided in the dielectric main body; and at least two port signal transmission holes are further provided in the dielectric main body; where the at least two port signal transmission holes and at least part of the plurality of frequency tuning blind holes are disposed on two opposite sides of the dielectric main body; and in a thickness direction of the dielectric main body, the at least two port signal transmission holes do not overlap with the plurality of frequency tuning blind holes.

In some embodiments, there is no capacitive coupling window disposed between the plurality of frequency tuning blind holes of the dielectric waveguide filter.

In some embodiments, both a left side and a right side of each of the at least two port signal transmission holes are provided with the frequency tuning blind holes.

In some embodiments, at least one of the at least two port signal transmission holes is disposed at a central position between two frequency tuning blind holes adjacent to the at least one port signal transmission hole.

In some embodiments, the plurality of frequency tuning blind holes includes eight frequency tuning blind holes, and the eight frequency tuning blind holes are arranged in two rows and four columns; the plurality of isolation slots includes a first isolation slot, a second isolation slot and a third isolation slot; the first isolation slot is disposed between a first column of frequency tuning blind holes and a second column of frequency tuning blind holes, the second isolation slot is disposed between the second column of frequency tuning blind holes and a third column of frequency tuning blind holes, and the third isolation slot is disposed between the third column of frequency tuning blind holes and a fourth column of frequency tuning blind holes; and the at least two port signal transmission holes includes a first port signal transmission hole and a second port signal transmission hole, where the first port signal transmission hole is disposed between the first column of frequency tuning blind holes and the second column of frequency tuning blind holes, and the second port signal transmission hole is disposed between the third column of frequency tuning blind holes and the fourth column of frequency tuning blind holes.

In some embodiments, the first isolation slot and the third isolation slot are in a cross shape, and the second isolation slot is in a shape of a line segment.

In some embodiments, the first port signal transmission hole and the second port signal transmission hole are symmetrical with respect to a centerline of the eight frequency tuning blind holes.

In some embodiments, the first isolation slot is connected to the second isolation slot.

In some embodiments, the plurality of frequency tuning blind holes are disposed along a straight line.

In some embodiments, at least part of the plurality of frequency tuning blind holes are disposed on a same side of the dielectric waveguide filter as the at least two port signal transmission holes.

In the technical solution of the embodiments of the present disclosure, an adopted dielectric waveguide filter includes the dielectric main body, where the plurality of isolation slots and the plurality of frequency tuning blind holes are disposed on the dielectric main body, and the at least two port signal transmission holes are further disposed on the dielectric main body; where the at least two port signal transmission holes and the at least part of the plurality of frequency tuning blind holes are disposed on the two opposite sides of the dielectric main body; and in the thickness direction of the dielectric main body, the at least two port signal transmission holes do not overlap with the at least part of the plurality of frequency tuning blind holes. An input signal on the at least two port signal transmission holes will generate a signal with a phase difference of −180° from the input signal by passing through the plurality of frequency tuning blind holes, that is, generate a transmission zero. Since a capacitive coupling column is not needed to generate the transmission zero, the difficulty of later debugging and optimization as well as the labor-hour cost can be greatly reduced, thereby facilitating miniaturization of the dielectric waveguide filter, and expanding the application range of the dielectric waveguide filter.

DETAILED DESCRIPTION

Figure 1:
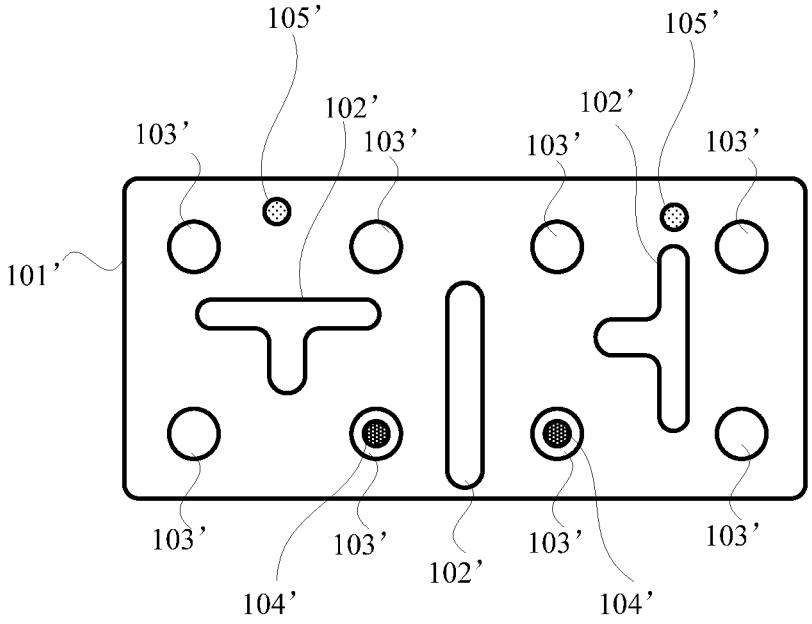
FIG. 1 is a schematic diagram of a dielectric waveguide filter in the related art.

Hereinafter the present disclosure will be further described in detail in conjunction with the drawings and embodiments. It is to be understood that the specific embodiments set forth herein are merely intended to illustrate and not to limit the present disclosure. Additionally, it is to be noted that for ease of description, merely part, not all, of the structures related to the present disclosure are illustrated in the drawings.

FIG. 1 is a schematic diagram of a dielectric waveguide filter according to the related art. Referring to FIG. 1, the dielectric waveguide filter includes a dielectric main body 101', a plurality of isolation slots 102', a plurality of frequency tuning blind holes 103' and a plurality of port signal transmission holes 104'. The plurality of port signal transmission holes 104' and the plurality of frequency tuning blind holes 103' are disposed on two opposite sides of the dielectric main body 101' and are located opposite to each other. If a transmission zero needs to be generated, a capacitive coupling column 105' needs to be disposed on the dielectric main body 101' such that a capacitive cross coupling is formed. However, it is difficult for later debugging and optimization of the capacitive coupling column 105', thereby resulting in high production cost of the dielectric waveguide filter in a later stage, and limiting application of the dielectric waveguide filter in 5G technology.

Based on the above-mentioned technical problem, the present disclosure proposes the following solving solution.

Figure 2:
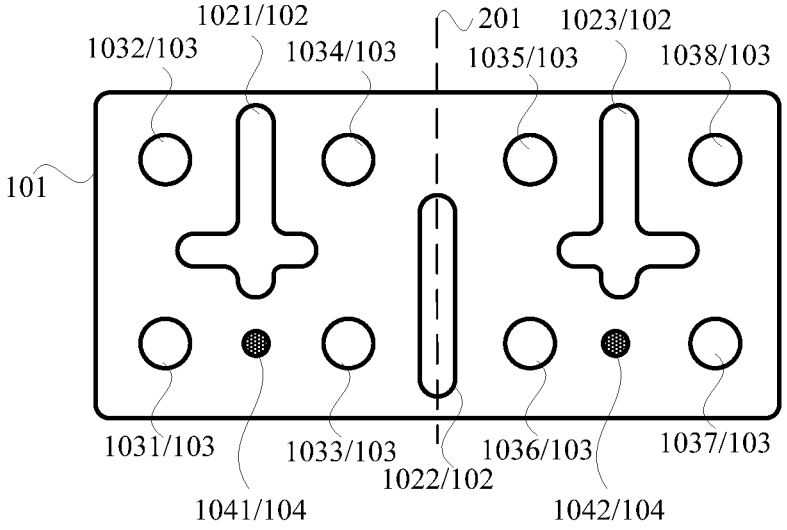
FIG. 2 is a schematic diagram of a dielectric waveguide filter according to an embodiment of the present disclosure.

FIG. 2 is a schematic diagram of a dielectric waveguide filter according to an embodiment of the present disclosure. Referring to FIG. 2, the dielectric waveguide filter includes a dielectric main body 101, where a plurality of isolation slots 102 and a plurality of frequency tuning blind holes 103 are disposed on the dielectric main body 101, and at least two port signal transmission holes 104 are further disposed on the dielectric main body 101; where the port signal transmission holes 104 and at least part of the plurality of frequency tuning blind holes 103 are disposed on two opposite sides of the dielectric main body 101; and in a thickness direction of the dielectric main body 101, the port signal transmission holes 104 do not overlap with the plurality of frequency tuning blind holes 103.

Specifically, the dielectric main body 101 may be a ceramic main body, the plurality of frequency tuning blind holes 103 are blind holes disposed on the dielectric main body 101, and a metal shielding layer, e.g., a copper shielding layer, may be disposed on a surface of the dielectric main body 101. The port signal transmission holes 104 are blind holes disposed on the dielectric main body 101. The port signal transmission holes 104 and the at least part of the plurality of frequency tuning blind holes 103 are disposed on the two opposite sides of the dielectric main body 101. For example, the at least part of the plurality of frequency tuning blind holes 103 are disposed on a front surface of the dielectric main body 101, and the port signal transmission holes 104 are disposed on a back surface of the dielectric main body 101. The port signal transmission hole 104 serves as an input port or an output port of the dielectric waveguide filter. In this embodiment, the port signal transmission holes 104 do not overlap with the frequency tuning blind holes 103 in the thickness direction of the dielectric main body 101. For example, after a signal is inputted from one port signal transmission hole 1041, the signal is transmitted in two ways. The signal of one way is transmitted to another port signal transmission hole 1042 through frequency tuning blind holes (1033-1034-1035-1036) while the signal of the other way generates a signal with a phase difference of −180° from an input signal of the port signal transmission hole 1041 after passing through frequency tuning blind holes (1031-1032), that is, a group of transmission zeros is generated. It could be understood that there is a signal of a way inputted from the another port signal transmission hole 1042 that generates a signal with a phase difference of −180° from an input signal of the port signal transmission hole 1042 after passing through frequency tuning blind holes (1037-1038), that is, another group of transmission zeros is generated. Thereby the dielectric waveguide filter of this embodiment can generate multiple transmission zeros. Since the capacitive coupling column is not needed, the difficulty of later optimization and debugging can be greatly reduced, the labor-hour cost can be greatly reduced, and meanwhile, miniaturization of the dielectric waveguide filter can be achieved, and an application range of the dielectric waveguide filter can be expanded. It could be understood that the thickness direction of the dielectric main body 101 is a direction perpendicular to a side of the dielectric main body 101 on which the frequency tuning blind holes 103 are disposed, and in this direction, the port signal transmission holes 104 do not overlap with the frequency tuning blind hole 103, that is, orthographic projections of the port signal transmission holes 104 in this direction do not overlap with orthographic projections of the frequency tuning blind holes 103 in this direction.

In a technical solution of the embodiments of the present disclosure, an adopted dielectric waveguide filter includes the dielectric main body, where the plurality of isolation slots and the plurality of frequency tuning blind holes are disposed on the dielectric main body, and the at least two port signal transmission holes are further disposed on the dielectric main body; where the port signal transmission holes and the at least part of the plurality of frequency tuning blind holes are disposed on the two opposite sides of the dielectric main body; and in the thickness direction of the dielectric main body, the port signal transmission holes do not overlap with the plurality of frequency tuning blind holes. The input signal on the port signal transmission hole will generate the signal with the phase difference of −180° from the input signal by passing through the frequency tuning blind hole, that is, the transmission zero is generated. Since the capacitive coupling column is not needed to generate the transmission zero, the difficulty of later debugging and optimization can be greatly reduced, and the labor-hour cost can be greatly reduced, and meanwhile the miniaturization of the dielectric waveguide filter is achieved and the application range of the dielectric waveguide filter is expanded.

In some embodiments, there is no capacitive coupling window disposed among the frequency tuning blind holes 103 of the dielectric waveguide filter, that is, there is no need of capacitive coupling column. In the embodiment, the frequency tuning blind holes 103 of this embodiment are all in an inductive cross coupling mode, which has a better stability and consistency.

In some embodiments, still referring to FIG. 2, both a left side and a right side of each of the port signal transmission hole 104 are provided with the frequency tuning blind holes 103. That is, the port signal transmission hole 104 is disposed between adjacent frequency tuning blind holes 103. In detail, a position of the port signal transmission hole 104 between the adjacent frequency tuning blind holes 103 may be adjusted as required. That is, the position may be closer to a certain frequency tuning blind hole 103 or located in the middle of the adjacent frequency tuning blind holes 103.

In this way, it can be ensured that the input signal of the port signal transmission hole 104 will have a signal passing through the frequency tuning blind hole 103 to generate a signal with a phase difference of −180° from the input signal, and it can be ensured that the transmission zero is generated, thereby improving out-of-band rejection capability of the dielectric waveguide filter.

Still referring to FIG. 2, in this embodiment and part of other embodiments, at least one port signal transmission hole 104 is disposed at a central position of the frequency tuning blind holes 103. In this embodiment and part of other embodiments, the port signal transmission holes 104 are all disposed at central positions of adjacent frequency tuning blind holes 103.

Exemplarily, both the port signal transmission holes 104 and the frequency tuning blind holes 103 are circular cavities. In other embodiments, the port signal transmission holes 104 and the frequency tuning blind holes 103 may be of other shapes. The port signal transmission hole 104 is disposed at the center position of frequency tuning blind holes 103 adjacent to the port signal transmission hole 104, such that the dielectric waveguide filter has a relatively simple and stable structure and better characteristics such as excellent consistency. The application range of the dielectric waveguide filter is further expanded.

In some embodiments, still referring to FIG. 2, the plurality of frequency tuning blind holes of this embodiment includes eight frequency tuning blind holes 103, and the eight frequency tuning blind holes 103 are arranged in two rows and four columns. The plurality of isolation slots 102 includes a first isolation slot 1201, a second isolation slot 1022 and a third isolation slot 1023. The first isolation slot 1021 is disposed between a first column of the frequency tuning blind holes 103 and a second column of the frequency tuning blind holes 103, the second isolation slot 1022 is disposed between the second column of the frequency tuning blind holes 103 and a third column of the frequency tuning blind holes 103, and the third isolation slot 1023 is disposed between the third column of the frequency tuning blind holes 103 and a fourth column of the frequency tuning blind holes 103. The at least two port signal transmission holes 104 includes a first port signal transmission hole 1041 and a second port signal transmission hole 1042, where the first port signal transmission hole 1041 is disposed between the first column of the frequency tuning blind holes 103 and the second column of the frequency tuning blind holes 103, and the second port signal transmission hole 1042 is disposed between the third column of the frequency tuning blind holes 103 and the fourth column of the frequency tuning blind holes 103.

Figure 3:
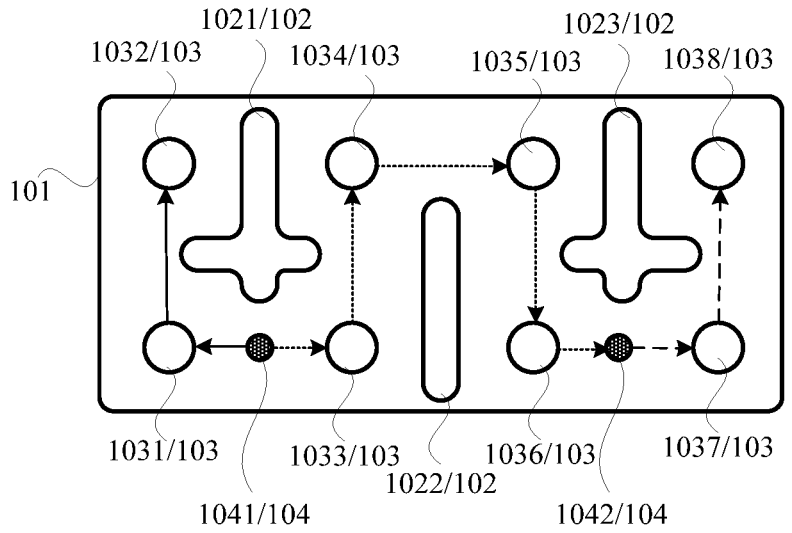
FIG. 3 is a schematic diagram illustrating a signal flow of a dielectric waveguide filter according to an embodiment of the present disclosure.
Figure 4:
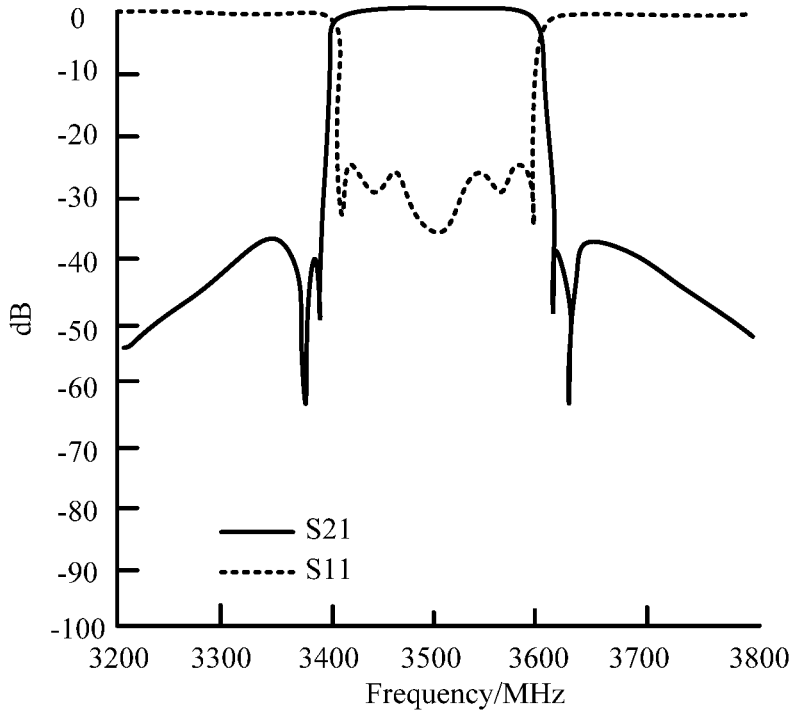
FIG. 4 is a schematic diagram illustrating the results of S-parameter curves of a dielectric waveguide filter according to an embodiment of the present disclosure.

Specifically, FIG. 3 is a schematic diagram of a signal process of a dielectric waveguide filter according to an embodiment of the present disclosure, which may correspond to the dielectric waveguide filter in FIG. 2. FIG. 4 is a schematic diagram illustrating results of S-parameter curves of a dielectric waveguide filter according to an embodiment of the present disclosure, which corresponds to the dielectric waveguide filter in FIG. 2. Referring to FIG. 2 to FIG. 4, the plurality of frequency tuning blind holes may include a first frequency tuning blind hole 1031, a second frequency tuning blind hole 1032, a third frequency tuning blind hole 1033, a fourth frequency tuning blind hole 1034, a fifth frequency tuning blind hole 1035, a sixth frequency tuning blind hole 1036, a seventh frequency tuning blind hole 1037 and an eighth frequency tuning blind hole 1038. The first port signal transmission hole 1041 may serve as the input port, and the second port signal transmission hole 1042 may serve as the output port. As shown in FIG. 3, a signal inputted from the first port signal transmission hole 1041 is divided into two ways. The signal of one way generates a signal with a phase difference of −180° from the signal inputted from the first port signal transmission hole 1041 by passing through the first frequency tuning blind hole 1031 and the second frequency tuning blind hole 1032, that is, a group of transmission zeros. The signal of another way is transmitted to the second port signal transmission hole 1042 after passing through the third frequency tuning blind hole 1033, the fourth frequency tuning blind hole 1034, the fifth frequency tuning blind hole 1035 and the sixth frequency tuning blind hole 1036. There is a signal of a way inputted from the second port signal transmission hole 1042 that is transmitted to the eighth frequency tuning blind hole 1038 by passing through the seventh frequency tuning blind hole 1037, thereby generating a signal with a phase difference of −180° from the input signal of the second port signal transmission hole 1042, that is, another group of transmission zeros. Therefore, a plurality of transmission zeros are generated without the need of the capacitive coupling column, improving the out-of-band rejection capability, and achieving the miniaturization of the dielectric waveguide filter. It is to be noted that sizes of the first frequency tuning blind hole 1031 and the second frequency tuning blind hole 1032 in this embodiment may be adjusted to change intensity of window coupling of the first frequency tuning blind hole 1031 and the second frequency tuning blind hole 1032, so as to adjust intensity of the transmission zero. In addition, a plurality of frequency tuning blind holes may be disposed in a transmission path from the first port signal transmission hole 1041 to the second frequency tuning blind hole 1032, thereby forming a dielectric waveguide filter with other numbers of zeros.

In some embodiments, still referring to FIG. 2, the first isolation slot 1021 and the third isolation slot 1023 are in a cross shape, and the second isolation slot is in a line segment shape.

In this way, process difficulty of the dielectric waveguide filter can be simplified and the production cost of the dielectric waveguide filter is reduced.

In some embodiments, still referring to FIG. 2, the first port signal transmission hole 1041 and the second port signal transmission hole 1042 are symmetrical with respect to a centerline of the eight frequency tuning blind holes.

Specifically, as illustrated in FIG. 2, both the eight frequency tuning blind holes and two port signal transmission holes are symmetrical with respect to a same centerline 201, and in such configuration, the dielectric waveguide filter can generate symmetrical transmission zeros.

It is to be noted that in the above-mentioned description, a number of frequency tuning blind holes on the left side of the first port signal transmission hole 1041 is 2, and a number of frequency tuning blind holes on the right side of the second port signal transmission hole 1042 is 2. However, this number is only an example, and in other embodiments, this number may also be (2, 1), (2, 0), (1, 2), (1, 1), (1, 0), (0, 1), (0, 2), . . . , respectively.

Figure 5:
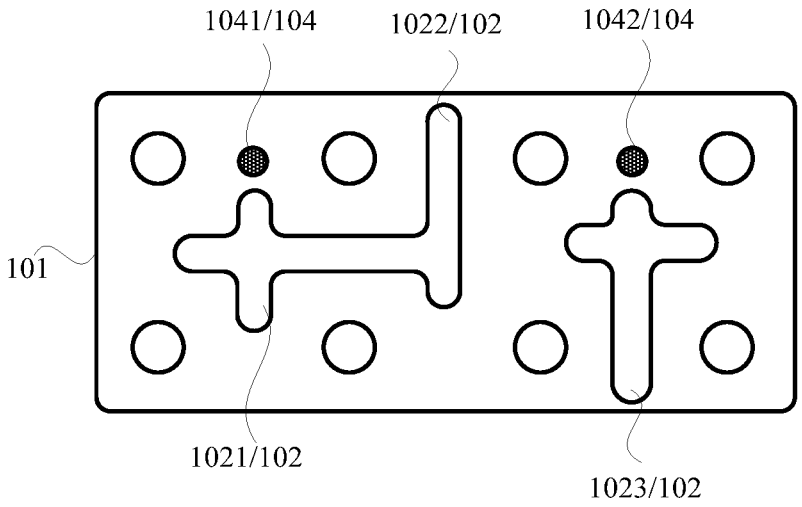
FIG. 5 is a schematic diagram of another dielectric waveguide filter according to an embodiment of the present disclosure.

In some embodiments, FIG. 5 is a schematic diagram of another dielectric waveguide filter according to an embodiment of the present disclosure. Referring to FIG. 5, the first isolation slot 1021 is connected to the second isolation slot 1022.

In this way, the dielectric waveguide filter can generate asymmetric transmission zeros. The principle of generating the asymmetric transmission zeros is similar to that of the transmission zeros of the dielectric waveguide filter shown in FIG. 2, and what has been described will not be repeated herein. Since no capacitive coupling column is needed to generate the transmission zero, the difficulty of later optimization and debugging can be greatly reduced, the labor-hour cost can be greatly reduced, and meanwhile, the miniaturization of the dielectric waveguide filter is achieved, and the application range of the dielectric waveguide filter is expanded.

Figure 6:
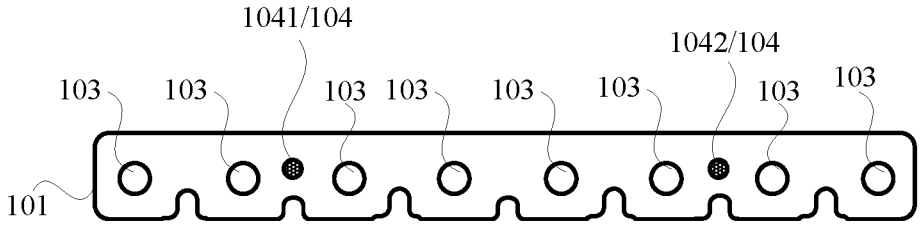
FIG. 6 is a schematic diagram of yet another dielectric waveguide filter according to an embodiment of the present disclosure.
Figure 7:
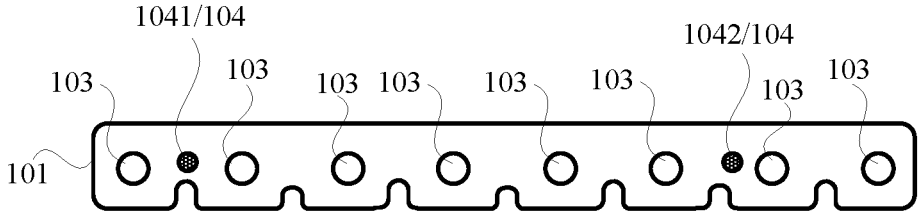
FIG. 7 is a schematic diagram of still another dielectric waveguide filter according to an embodiment of the present disclosure.

In some embodiments, FIG. 6 is a schematic diagram of another dielectric waveguide filter according to an embodiment of the present disclosure. FIG. 7 is a structural diagram of another dielectric waveguide filter according to an embodiment of the present disclosure. Referring to FIG. 6 and FIG. 7, the plurality of frequency tuning blind holes 103 are located at the same straight line.

Specifically, in this embodiment, the frequency tuning blind holes may be arranged in a column, the port signal transmission holes 104 do not overlap with the frequency tuning blind holes 103, such that the input signal on the port signal transmission holes 104 passes through the frequency tuning blind holes 103 to generate a signal with a phase difference of −180° from the input signal, that is, to generate the transmission zero. Since no capacitive coupling column is needed to generate the transmission zero, the difficulty of later optimization and debugging can be greatly reduced, the labor-hour cost can be greatly reduced, and meanwhile the miniaturization of the dielectric waveguide filter is achieved, and the application range of the dielectric waveguide filter is expanded. In FIG. 6, the first port signal transmission hole 1041 and the second port signal transmission hole 1042 are symmetrical with respect to a centerline of the dielectric waveguide filter, and in such configuration, symmetrical transmission zeros can be generated. In FIG. 7, the first port signal transmission hole 1041 and the second port signal transmission hole 1042 are not symmetrical with respect to the centerline of the dielectric waveguide filter, and in such configuration, asymmetrical transmission zeros can be generated.

In some embodiments, at least part of the plurality of frequency tuning blind holes and the port signal transmission holes are disposed on a same side of the dielectric waveguide filter.

Specifically, the frequency tuning blind holes may be disposed on two sides of the dielectric waveguide filter, that is, frequency tuning blind holes in a form of a blind hole are disposed on two sides of the dielectric main body, and the frequency tuning blind holes on two sides of the dielectric main body may be at opposite positions in such configuration, so as to improve remote suppression performance of the dielectric waveguide filter.

It is to be noted that in other embodiments, the dielectric main body may be of double layer, where a setting location of the frequency tuning blind holes is well known to those skilled in the art and will not be repeated herein. The dielectric waveguide filter of this embodiment can generate transmission zeros or symmetric transmission zeros with any number and any position; the frequency tuning blind holes are all inductive cross-coupled with good stability and consistency; the cavity arrangement is more flexible, that is, the arrangement may be in-line, double-row or double-layer, and the structure is simple and stable; and the process is less difficult, the production cost is low, the structural consistency is excellent, and the application range is wider.

The foregoing merely depicts some exemplary embodiments according to the present disclosure and the technical principles used therein. Those having ordinary skill in the art will appreciate that the present disclosure will not be limited to the specific embodiments described herein, and that various apparent modifications, adaptations and substitutions can be made without departing from the scope of the present disclosure. Thus, while the present disclosure has been described in detail by way of the above-described embodiments, the present disclosure will not be limited to the above-mentioned embodiments and may further include more other equivalent embodiments without departing from the concept of the present disclosure. The scope of the present disclosure is thus determined by the scope of the appended claims.

What is claimed is:

1. A dielectric waveguide filter, comprising:

a dielectric main body, provided with a plurality of isolation slots, a plurality of frequency tuning blind holes, and at least two port signal transmission holes;

wherein the at least two port signal transmission holes and at least part of the plurality of frequency tuning blind holes are provided at two opposite sides of the dielectric main body, and the at least two port signal transmission holes do not overlap with the plurality of frequency tuning blind holes in a thickness direction of the dielectric main body;

wherein both a left side and a right side of each of the at least two port signal transmission holes are provided with the frequency tuning blind holes.

2. The dielectric waveguide filter of claim 1, wherein the plurality of frequency tuning blind holes is disposed along a straight line.

3. The dielectric waveguide filter of claim 1, wherein at least part of the plurality of frequency tuning blind holes are provided at a same side of the dielectric waveguide filter as the at least two port signal transmission holes.

4. The dielectric waveguide filter of claim 1, wherein there is no capacitive coupling window disposed between the plurality of frequency tuning blind holes.

5. The dielectric waveguide filter of claim 4, wherein the plurality of frequency tuning blind holes comprise eight frequency tuning blind holes, which are arranged in two rows and four columns;

the plurality of isolation slots comprise a first isolation slot, a second isolation slot, and a third isolation slot;

the first isolation slot is disposed between a first column of the frequency tuning blind holes and a second column of the frequency tuning blind holes, the second isolation slot is disposed between the second column and a third column of the frequency tuning blind holes, and the third isolation slot is disposed between the third column and a fourth column of the frequency tuning blind holes; and the at least two port signal transmission holes comprise a first port signal transmission hole and a second port signal transmission hole, wherein the first port signal transmission hole is disposed between the first column and the second column of the frequency tuning blind holes, and the second port signal transmission hole is disposed between the third column and the fourth column of the frequency tuning blind holes.

6. The dielectric waveguide filter of claim 4, wherein the plurality of frequency tuning blind holes is disposed along a straight line.

7. The dielectric waveguide filter of claim 1, wherein at least one of the at least two port signal transmission holes is disposed at a central position between two of the frequency tuning blind holes adjacent to the at least one of the port signal transmission holes.

8. The dielectric waveguide filter of claim 7, wherein the plurality of frequency tuning blind holes comprise eight frequency tuning blind holes, which are arranged in two rows and four columns;

the plurality of isolation slots comprise a first isolation slot, a second isolation slot, and a third isolation slot;

the first isolation slot is disposed between a first column of the frequency tuning blind holes and a second column of the frequency tuning blind holes, the second isolation slot is disposed between the second column and a third column of the frequency tuning blind holes, and the third isolation slot is disposed between the third column and a fourth column of the frequency tuning blind holes; and the at least two port signal transmission holes comprise a first port signal transmission hole and a second port signal transmission hole, wherein the first port signal transmission hole is disposed between the first column and the second column of the frequency tuning blind holes, and the second port signal transmission hole is disposed between the third column and the fourth column of the frequency tuning blind holes.

9. The dielectric waveguide filter of claim 7, wherein the plurality of frequency tuning blind holes is disposed along a straight line.

10. The dielectric waveguide filter of claim 7, wherein at least part of the plurality of frequency tuning blind holes are provided at a same side of the dielectric waveguide filter as the at least two port signal transmission holes.

11. The dielectric waveguide filter of claim 1, wherein the plurality of frequency tuning blind holes comprise eight frequency tuning blind holes, which are arranged in two rows and four columns;

the plurality of isolation slots comprise a first isolation slot, a second isolation slot, and a third isolation slot;

the first isolation slot is disposed between a first column of the frequency tuning blind holes and a second column of the frequency tuning blind holes, the second isolation slot is disposed between the second column and a third column of the frequency tuning blind holes, and the third isolation slot is disposed between the third column and a fourth column of the frequency tuning blind holes; and the at least two port signal transmission holes comprise a first port signal transmission hole and a second port signal transmission hole, wherein the first port signal transmission hole is disposed between the first column and the second column of the frequency tuning blind holes, and the second port signal transmission hole is disposed between the third column and the fourth column of the frequency tuning blind holes.

12. The dielectric waveguide filter of claim 11, wherein the first isolation slot and the third isolation slot are in a cross shape, and the second isolation slot is in a shape of a line segment.

13. The dielectric waveguide filter of claim 12, wherein the first port signal transmission hole and the second port signal transmission hole are symmetrical with respect to a centerline of the eight frequency tuning blind holes.

14. The dielectric waveguide filter of claim 12, wherein the first isolation slot is connected to the second isolation slot.

15. A dielectric waveguide filter, comprising:

a dielectric main body, provided with a plurality of isolation slots, a plurality of frequency tuning blind holes, and at least two port signal transmission holes;

wherein the at least two port signal transmission holes and at least part of the plurality of frequency tuning blind holes are provided at two opposite sides of the dielectric main body, and the at least two port signal transmission holes do not overlap with the plurality of frequency tuning blind holes in a thickness direction of the dielectric main body;

wherein at least part of the plurality of frequency tuning blind holes are provided at a same side of the dielectric waveguide filter as the at least two port signal transmission holes.

16. A dielectric waveguide filter, comprising:

a dielectric main body, provided with a plurality of isolation slots, a plurality of frequency tuning blind holes, and at least two port signal transmission holes;

wherein the at least two port signal transmission holes and at least part of the plurality of frequency tuning blind holes are provided at two opposite sides of the dielectric main body, and the at least two port signal transmission holes do not overlap with the plurality of frequency tuning blind holes in a thickness direction of the dielectric main body;

wherein there is no capacitive coupling window disposed between the plurality of frequency tuning blind holes;

wherein at least part of the plurality of frequency tuning blind holes are provided at a same side of the dielectric waveguide filter as the at least two port signal transmission holes.

* * * * *